US009966003B2

(12) United States Patent
Cho et al.

(10) Patent No.: US 9,966,003 B2
(45) Date of Patent: May 8, 2018

(54) ORGANIC LIGHT-EMISSION DISPLAY DEVICE WITHOUT FLICKERING

(71) Applicant: LG DISPLAY CO., LTD., Seoul (KR)

(72) Inventors: MinSu Cho, Gyeonggi-do (KR); HyunJae Lee, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 379 days.

(21) Appl. No.: 14/804,788

(22) Filed: Jul. 21, 2015

(65) Prior Publication Data

US 2016/0163258 A1 Jun. 9, 2016

(30) Foreign Application Priority Data

Dec. 5, 2014 (KR) ..... 10-2014-0174220

(51) Int. Cl.

| | |
|---|---|
| ***G09G 5/10*** | (2006.01) |
| ***G09G 3/3225*** | (2016.01) |
| ***G09G 3/20*** | (2006.01) |
| ***G09G 3/3233*** | (2016.01) |

(52) U.S. Cl.

CPC ..... *G09G 3/3225* (2013.01); *G09G 3/20* (2013.01); *G09G 3/3233* (2013.01); *G09G 2320/0247* (2013.01); *G09G 2320/043* (2013.01); *G09G 2320/0666* (2013.01); *G09G 2330/021* (2013.01); *G09G 2340/16* (2013.01); *G09G 2360/16* (2013.01)

(58) Field of Classification Search

CPC ..... G09G 3/3225; G09G 2320/0247; G09G 2320/0276; G09G 2320/0626; G09G 2320/0233; G09G 2360/16; G09G 2300/0452; G09G 2330/028

USPC ..... 345/690

See application file for complete search history.

(56) References Cited

U.S. PATENT DOCUMENTS

| | | | | |
|---|---|---|---|---|
| 2005/0024353 | A1* | 2/2005 | Amundson | G02F 1/167 345/204 |
| 2007/0085785 | A1* | 4/2007 | Ozaki | G09G 3/2025 345/77 |
| 2008/0007494 | A1* | 1/2008 | Kim | G09G 3/3225 345/77 |
| 2009/0278850 | A1* | 11/2009 | Shinkawa | A63F 13/10 345/442 |
| 2009/0322796 | A1* | 12/2009 | Yoshida | G09G 5/006 345/690 |

* cited by examiner

*Primary Examiner* — Nelson Rosario
*Assistant Examiner* — Andrew Lee
(74) *Attorney, Agent, or Firm* — Dentons US LLP

(57) ABSTRACT

Disclosed is a display device that may include a display panel; and a plurality of drivers that control the display panel to display images and include an image control circuit, the image control circuit including: an average picture level (APL) circuit that analyzes first and second input image data for first and second time intervals and calculates first and second APLs, respectively, wherein the second time interval precedes the first time interval, an adjusted-APL generator that generates an adjusted-APL for the first input image data based on a comparison between the first and second APLs, and a luminance adjustment controller that adjusts a luminance of the display panel for the first input image data based on the adjusted-APL.

18 Claims, 6 Drawing Sheets

| NO | B7 | B6 | B5 | B4 | B3 | B2 | B1 | B0 |
|---|---|---|---|---|---|---|---|---|
| 1 | AL_GRN | | | | AL_RED | | | |
| 2 | — | — | — | — | AL_BLU | | | |
| 3 | — | LIMIT_PLC | | | | | | |
| 4 | AL_TH_EN | AL_TH | | | | | | |
| 5 | — | — | — | AL_FR | | | | |
| 6 | DIM_SLOPE | | | | | | | |

FIG. 3

ORGANIC LIGHT-EMISSION DISPLAY DEVICE WITHOUT FLICKERING

This application claims the priority of Korean Patent Application No. 10-2014-0174220 filed on Dec. 5, 2014, in the Korean Intellectual Property Office, the entire disclosure of which is incorporated herein by reference for all purposes as if fully set forth herein.

BACKGROUND OF THE INVENTION

Field of the Invention

The present invention relates to a display device and a method of driving the same. More specifically, the present invention relates to an organic light-emitting display device and method of driving the same that is capable of reducing flicker.

Discussion of the Related Art

Recently, various types of displays, which have reduced weight and volume when compared to those of cathode ray tube displays, have been developed. Examples for these types of displays include liquid crystal displays (LCDs), field emission displays, plasma display panels (PDPs), organic light-emitting diode (OLED) displays, and the like.

OLED displays can display images using organic light-emitting diodes which emit light through the recombination of electrons and holes. OLED displays also have many advantages such as fast response speeds and low power consumption.

With increasing demands on a large scale OLED device, studies on saving power consumption of such a large OLED device have been carried out.

In this connection, Korean Patent Application Publication No. 2011-0034985 discloses a display device that is directed to saving power consumption. Also, Korean Patent Application Publication No. 2011-0086244 describes a display device that is directed to reducing power consumption using a PLC (peak luminance control) technique.

SUMMARY OF THE INVENTION

Accordingly, the present invention is directed to provide a display device and method of driving the same that substantially obviates one or more problems due to limitations and disadvantages of the related art.

An advantage of the present invention is directed to an organic light-emitting display device and method of driving the same that is capable of reducing flicker.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include a display panel; and a plurality of drivers that control the display panel to display images and include an image control circuit, the image control circuit including: an average picture level (APL) circuit that analyzes first and second input image data for first and second time intervals and calculates first and second APLs, respectively, wherein the second time interval precedes the first time interval, an adjusted-APL generator that generates an adjusted-APL for the first input image data based on a comparison between the first and second APLs, and a luminance adjustment controller that adjusts a luminance of the display panel for the first input image data based on the adjusted-APL.

In another aspect of the present invention, a method of driving a display device having a display panel, the method may, for example, include analyzing first and second input image data for first and second time intervals and calculating first and second APLs, respectively, wherein the second time interval precedes the first time interval; comparing the first APL with the second APL; determining whether or not an absolute value of a difference between the first and second APLs is equal to or higher than a threshold value; generating an adjusted-APL for the first input image data based on the absolute value of the difference between the first and second APLs, when the absolute value of the difference is equal to or higher than the threshold value; and adjusting a luminance of the display panel for the first input image data based on the adjusted-APL.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 illustrates a table of luminance-control parameters according to an exemplary embodiment of the present disclosure;

DETAILED DESCRIPTION OF THE ILLUSTRATED EMBODIMENTS

Reference will now be made in detail to embodiments of the present invention, examples of which are illustrated in the accompanying drawings.

In the following description, it should be noted that references to "an" or "one" embodiment in this disclosure are not necessarily to the same embodiment, and such references mean at least one.

Although first, second, and the like are used in order to describe various components, the components are not limited by the terms. The above terms are used only to discriminate one component from the other component. Therefore, a first component mentioned below may be a second component within the technical spirit of the present disclosure.

Respective features of various exemplary embodiments of the present disclosure can be partially or totally joined or combined with each other and as sufficiently appreciated by those skilled in the art. Various interworking or driving can be technologically achieved and the respective exemplary embodiments may be executed independently from each other or together executed through an association relationship.

A suffix "unit" used for constituent elements disclosed in the following description is merely intended for easy description of the specification, and the suffix itself does not give any special meaning or function. In describing the present disclosure, if a detailed explanation for a related known function or construction is considered to unnecessarily divert the gist of the present disclosure, such explanation has been omitted but would be understood by those skilled in the art.

Figure 1:
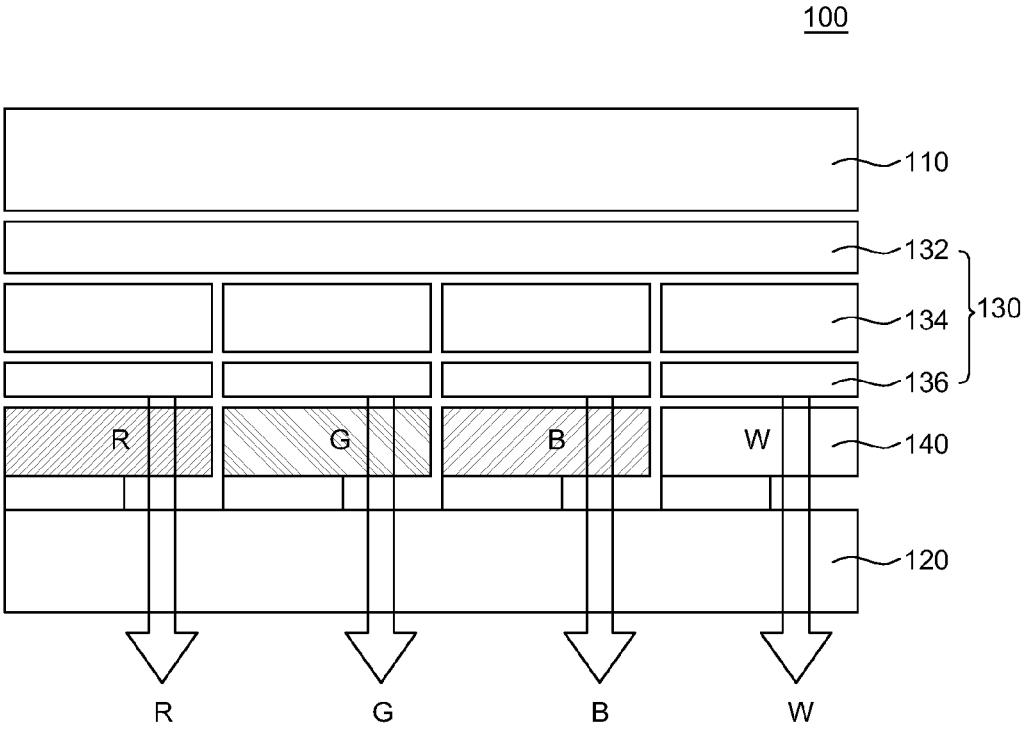
FIG. 1 illustrates a cross-sectional view of an organic light-emitting display device according to an exemplary embodiment of the present disclosure.

In FIG. 1, an organic light-emitting display (hereinafter, OLED) device 100 includes a display panel to display thereon an image, various drivers including a gate driver, data driver, and the like, a timing controller to control driving times of the drivers, and various units to carry out operations described therein below.

The display panel may include first and second substrates 110 and 120. On the first substrate 100, an organic EL diode 130, and the like may be formed, and on the second substrate 120, red, green, blue, and white color filter patterns (R, G, B, W) may be formed. The first and second substrates 110 and 120 may be made of transparent glass or flexible-plastic or polymer film materials.

The display panel may have therein gate and data lines to cross each other to define pixels. Each pixel may include switching and driving transistors, storage capacitors, organic EL diodes 130, and the like.

For driving the pixel, a scan signal may be first supplied via the gate line to turn on the switching transistor, and then a data signal may be supplied via the data line to a gate electrode of the driving transistor. The driving transistor may be turned on by the data signal to allow a current to flow in the organic EL diode to generate a light-emission thereof. The intensity of the light emission may be proportional to the current in the diode. The amount of current in the diode may be proportional to the data signal applied to the driver transistor. In this way, the display device may implement different gradations (gray) via application of different data signals to the pixel.

The storage capacitor may maintain the data signal during a single frame to keep the current amount in the diode constant and thus the gradation (gray) level from the diode.

The EL diode 130 may have a stack of a first electrode 131, a light-emission layer 134 and a second electrode 136 in this order. The first electrode 132 as an anode may be made of indium tin oxide. The light-emission layer 134 may be formed over the first electrode 132 to emit a white light toward the second electrode 136.

The second electrode 136 as a cathode may be formed over the light-emission layer 134 and may contain a metal with a lower work function to improve electron-injection level. Such a metal may be, for example, an alkali metal such as lithium and an alkali earth metal such as magnesium.

Between the light-emission layer 134 and the first electrode 132, and the second electrode 136, there may be a stack of first and second light-emission compensation layers to enhance light-emission efficiency.

The data driver may include at least one driver IC to supply data signals to the display panel. To do so, the data driver may generate a data signal using a video signal (R/G/B) and data control signals from the timing controller, and may supply the data signal to the display panel.

The gate driver may be formed in a so-called GIP (gate in panel) manner, and may generate a scan signal using a control signal supplied from the timing controller, and the scan signal may be supplied to the display panel. The gate signals may include a gate state pulse, gate shift clock, etc.

The timing controller (or control unit) may receive a number of control signals such as video signals, Vsync, Hsync, data enable (DE) signal etc. from, for example, a graphic card system via, for example, LVDS (Low Voltage Differential Signal) interface. The timing controller may generate data signals and supply them to the driver IC of the data driver.

The OLED device 100 may further include a power supply to supply the power and drive the components of the device. The power supply may generate driver voltages using a power voltage from an external source.

The OLED device 100 may apply a peak luminance control (PLC) function in order to reduce the power consumption and increase the lifetime thereof.

The PLC function may serve to automatically control a luminance based on a screen brightness to reduce the average power consumption. However, when performing the PLC function, APL (Average Picture Level) per frame may sharply vary, resulting in a change of the highest voltage $\gamma$ (gamma) corresponding thereto. This may lead to flicker since an abrupt change in gamma may cause an overall luminance change. Therefore, there is a need for addressing such a sharp luminance change caused by a rapid change in APL. Hereinafter, a PLC function or scheme that is capable of reducing flicker, which is applied to an OLED device, will be described in detail by way of example.

Figure 2A:
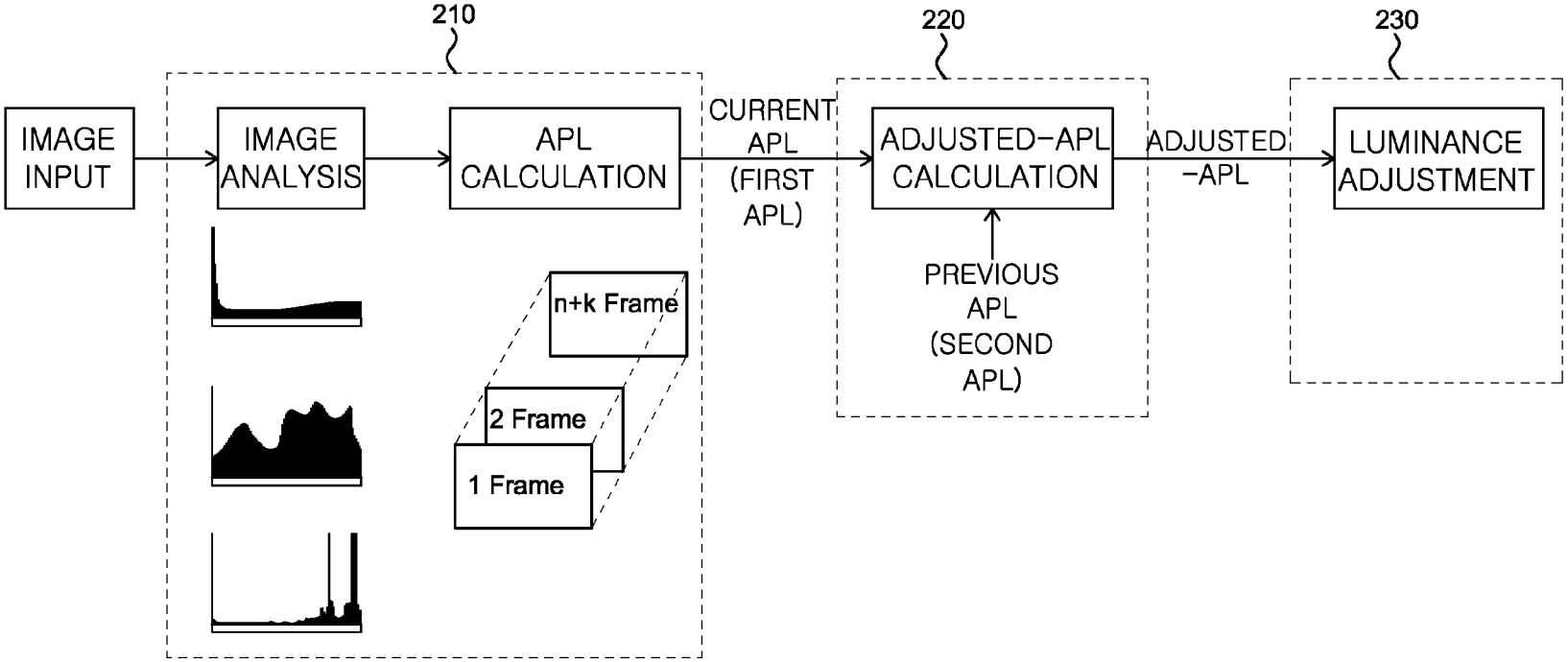
FIGS. 2A and 2B are block diagrams illustrating a method of controlling a luminance according to an exemplary embodiment of the present disclosure.
Figure 2B:
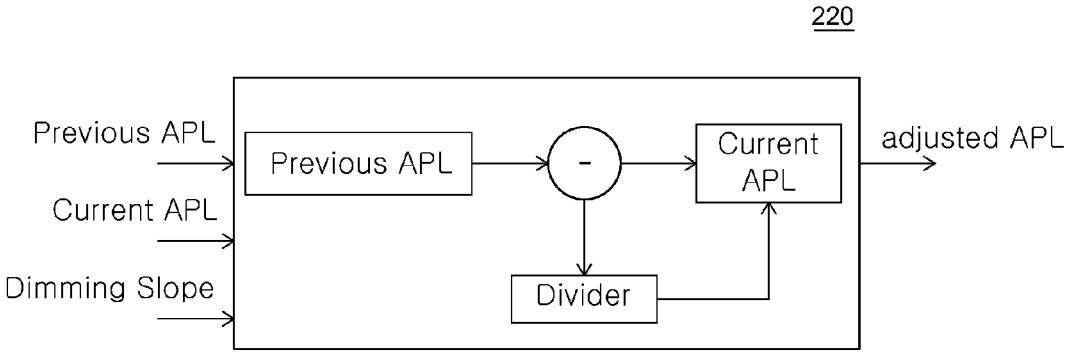

FIGS. 2A and 2B are block diagrams illustrating a method of controlling a luminance according to an exemplary embodiment of the present invention.

An OLED device may control or adjust a luminance by applying a PLC function. This luminance control may be carried out by an image controller, a timing controller, or driver IC, etc. on a hardware and/or software basis. Such control may be performed by a single entity having multiple functionalities combined as an integrated circuit or otherwise merged together, or by two or more entities that share cooperative functions.

Referring to FIG. 2A, an image controller according to an embodiment of the present invention may include an APL calculation unit (a first semiconductor circuit) 210, an adjusted-APL generation unit (a second semiconductor circuit) 220 and a luminance adjustment unit (a third semiconductor circuit) 230. This image controller may be a part of the OLED device 100. Thus, as used herein, the image control via the OLED device may mean via the image controller.

When a frame containing a specific image is input, the APL calculation unit 210 may analyze an input frame data corresponding to the specific image to calculate or acquire a first APL for the input frame. The APL represents a ratio of an average brightness of the input frame data for the current frame to a maximum brightness set for each frame. Thus, as the given image is displayed brighter, the APL is placed nearer to 100%, and as the given image is displayed darker, the APL is placed nearer to 0%.

The APL may be calculated on a single-frame basis or on a basis of plural frames. In other words, the APL calculation unit 210 may calculate an APL per one frame or one frame-block, with the block consisting of a number of frames.

The APL may be calculated to reflect video characteristics of the input frame. For example, the APL may be calculated to be correlated with the respective numbers of red, green and blue pixels rendered to present the image contained in the input frame. Further, in calculating the APL, weight factors may be applied, and the weight factors are respectively pre-determined for the red, green and blue pixels driven (turned-on) to present the image contained in the input frame.

One example of such calculating of the APL may be as follows:

$$APL = \frac{\sum_{j=0}^{HE} \sum_{i=0}^{VE} (aR_{ij} + bG_{ij} + cB_{ij})}{HE \times VE \times 2^g} \quad \text{(eq. 1)}$$

where $R_{ij}$, $G_{ij}$, and $B_{ij}$ respectively represent values of red, green and blue pixels turned-on in a (i,j) coordinate in the input frame; a, b, and c represent weight factors respectively defined with respect to the red, green and blue pixels; HE and VE represent numbers of coordinates in horizontal and vertical directions, respectively; and g represents a gray depth.

The a, b, and c may be defined to be 0.2, 0.7 and 0.1, respectively. That is, the blue color may have a relatively lower weight factor due to its lower contribution to brightness or darkness, while the green color may have a relatively higher weight factor due to its higher contribution. The g may be usually 8 (256 colors).

When the APL in a unit frame (e.g., a single frame or plural frames) changes rapidly, the OLED device may adjust a rate of the change to buffer or reduce a corresponding sharp luminance change. In particular, the image controller may allow a display luminance to change in a buffering or reduced slope to lead to a dimming effect. Thus, due to the dimming effect, the viewer may notice less flicker.

To accomplish the dimming effect, the adjusted-APL generation unit 220 may generate an adjusted-APL for the current input frame based on comparison between first and second APLs, where the first APL may be calculated for the current input frame and the second APL may be calculated for a previous input frame. A predetermined interval may be placed between the current and previous frames. As disclosed above, the adjusted-APL may serve to buffer the change between the frames. A luminance adjustment of the OLED device may be performed based on the adjusted-APL.

The generation unit 220 may be configured to generate the adjusted-APL based on a difference therebetween, when the first and second APLs are unequal. In other words, the generation unit 220 may be configured not to generate the adjusted-APL, when the first and second APLs are equal. In a non-event of the adjusted-APL generation, the first APL may be employed as is.

The adjusted-APL may be calculated based on the difference between the first and second APLs. One example of such an adjusted-APL generation may be as follows:

Adjusted_APL=Second_APL+(First_APL−Second_APL)/dimming slope, (eq. 2), where the dimming slope represents a buffering degree.

As seen from the above equation, with a lower dimming slope, the adjusted-APL may tend to be close to the first APL for the current input frame. To the contrary, with a higher dimming slope, the adjusted-APL may tend to be close to the second APL for the previous input frame. In this way, the lower dimming slope may contribute to a higher APL change rate, namely a sharp APL change, while the higher dimming slope may contribute to a lower APL change rate, namely, a gentle APL change.

The second equation may result in three following conditions on the latter term "(First_APL−Second_APL)/dimming slope": positive, negative and zero. For these three conditions, an APL adjustment may be as follows:

(1) Current APL (first APL)>Previous APL (second APL): the APL for the current frame increases relative to the APL for the previous frame. In this case, additive APL adjustment may be applied. That is, the adjusted-APL may increase by the term "(First_APL−Second_APL)/dimming slope" value.

(2) Current APL (first APL)<Previous APL (second APL): the APL for the current frame decreases relative to the APL for the previous frame. In this case, subtractive APL adjustment may be applied. That is, the adjusted-APL may decrease by the term "(First_APL−Second_APL)/dimming slope" value.

(3) Current APL (first APL)=Previous APL (second APL): the APL for the current frame is equal to the APL for the previous frame. In this case, there is no APL adjustment. Thus, the luminance may not change.

To perform the above operations, the generation unit 220 may include an operation unit (such as a +/− calculator) and a divider as illustrated in FIG. 2B.

The generation unit 220 may be subject to a threshold-based operation. Only when the first APL is above a predetermined threshold, the generation unit 220 may be triggered and generate the adjusted-APL.

The luminance adjustment unit 230 may control the luminance for the current frame based on the generated adjusted-APL. In other words, the luminance of the current frame may be adjusted in a corresponding manner to the adjusted-APL. The luminance adjustment unit 230 may change the luminance by a predetermined value corresponding to that of the adjusted-APL. To do so, in one embodiment, the luminance adjustment unit 230 may adjust the luminance with reference to and in correspondence with a look-up table of APL and gamma voltages. For example, the look-up table (or other types of entities) may be used to store a set of the adjusted-APLs and a set of gamma voltages (e.g., highest gamma voltages) that correspond to each other on a one-to-one basis so that each adjusted-APL has a corresponding gamma voltage. Such a table may be stored in the luminance adjustment unit 230 or in a separate location.

The image controller (or the OLED display device) may have a storage to store therein the first, second and adjusted APLs, and control parameters (operation threshold, dimming slope, and the like). The storage may supply the second APL on request thereof by the generation unit 220, and may store therein the adjusted-APL generated by the generation unit 220. Further, the storage unit may supply the adjusted-APL to the luminance adjustment unit 230.

Figure 4:
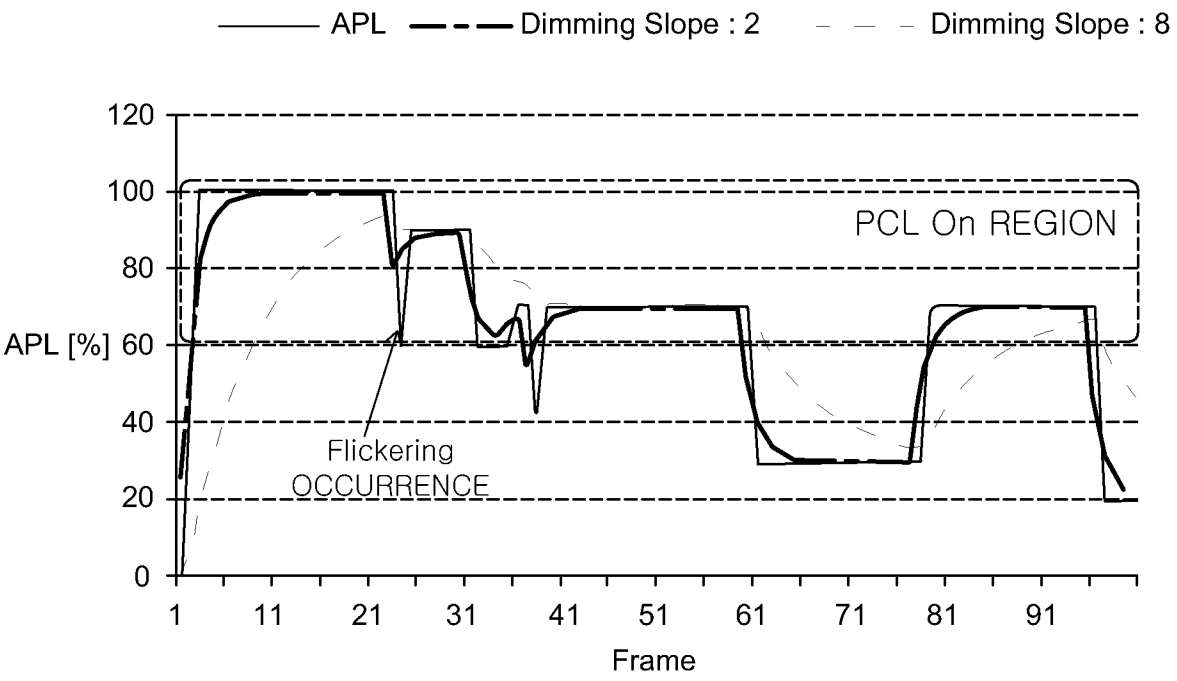
FIG. 4 illustrates a graph of an average picture level according to an exemplary embodiment of the present disclosure.

FIG. 3 illustrates a table of luminance-control parameters according to an exemplary embodiment of the present disclosure. These parameters may be employed to generate the adjusted-APL as described with reference to FIGS. 2A and 2B. These parameters may be stored in the storage (memory, register, or the like) and transferred to an associated functional unit as needed. The parameters may be configured in a register as shown in FIG. 3. Each definition of fields as shown in FIG. 3 is as follows:

AL_RED: red weight factor
AL_GRN: green weight factor
AL_BLU: blue weight factor
LIMIT_PLC: APL value at PLC operation start AL_TH_EN: whether to activate APL initialization in case of current APL exceeding APL limit AL_TH: APL limit AL_FR: number of frames in a frame-block in case of APL calculation for the frame-block DIM_SLOPE: buffering factor for APL change rate; dimming rate adjustment factor FIG. 4 illustrates a graph of an average picture level according to an exemplary embodiment of the present disclosure. The graph shows a difference between an original APL change and an adjusted-APL change. In the latter case, each of the dimming slopes 2 and 8 was applied. An APL threshold for applying the adjusted-APL was set to be 60%. The PLC behavior using the original APL shows a sharp luminance change due to a rapid APL change. This leads to flicker. To the contrary, the PLC behavior using the adjusted-APL shows a gentle luminance change due to a lower APL change rate. This can reduce flicker.

Figure 5:
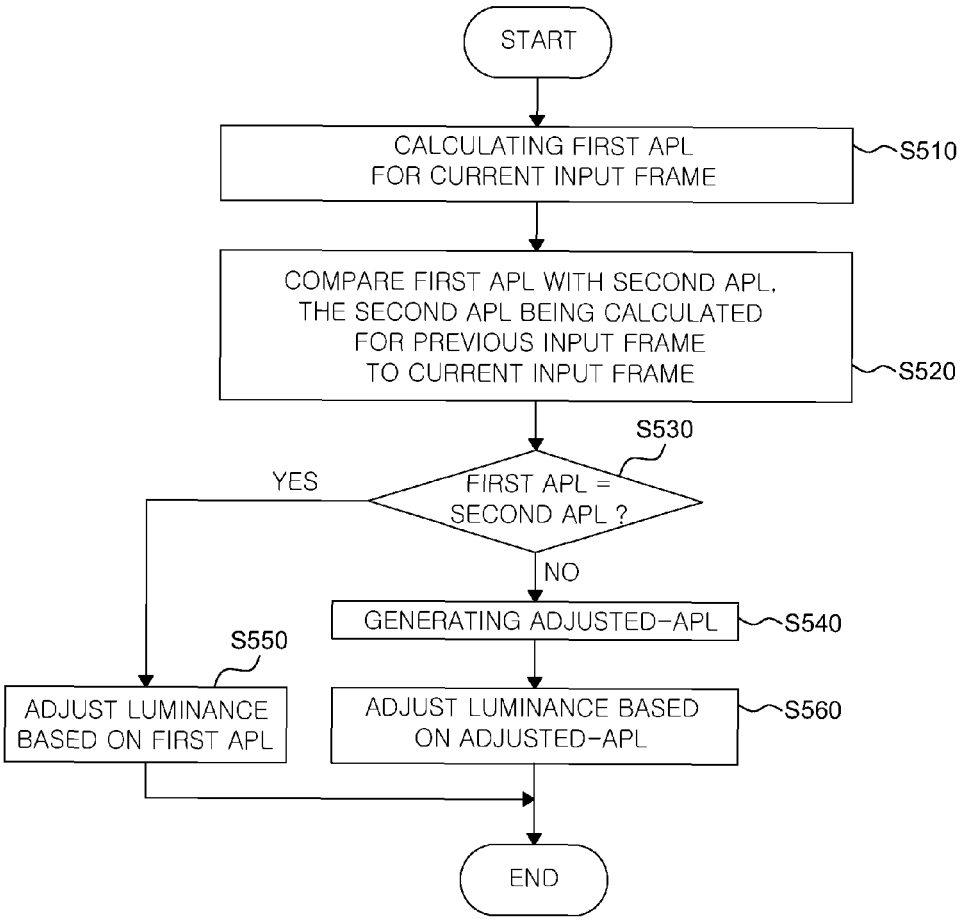
FIG. 5 illustrates a flowchart of controlling an image in the OLED device according to an exemplary embodiment of the present disclosure.

FIG. 5 illustrates a flowchart of controlling an image in the OLED device according to an exemplary embodiment of the present disclosure. The controlling operations may be carried out by the OLED device, or specifically by the image controller thereof, as described with reference to FIG. 1 to FIG. 4.

First, this method proceeds to operation S510 where the OLED device, using the APL calculation unit 210, analyzes an input frame data having a specific image to calculate or acquire a first APL for the input frame. The APL may be calculated on a single-frame basis or on a basis of plural frames. In other words, the APL calculation unit 210 may calculate an APL per one frame, one frame-block, or a block consisting of a number of frames.

The APL may be calculated to reflect video characteristics of the input frame. For example, the APL may be calculated to be correlated with the respective numbers of red, green and blue pixels driven (turned on) to present the image contained in the input frame. Further, in calculating the APL, weight factors may be applied, where the weight factors being respectively pre-determined for the red, green and blue pixels are rendered to present the image contained in the input frame. In case of a combination of the former and latter, the application of the factors may be carried out for respective numbers of the red, green and blue pixels corresponding to the current frame.

One example of such a combination in calculating the APL may be as follows:

$$APL = \frac{\overset{HE}{\underset{j=0}{Q}}\ \overset{VE}{\underset{i=0}{Q}}(aR_{ij} + bG_{ij} + cB_{ij})}{HE_S VE_S 2^g} \quad \text{(eq. 1)}$$

where $R_{ij}$, $G_{ij}$, and $B_{ij}$ respectively represent red, green and blue pixels rendered in a (i,j) position in the input frame; a, b, and c represent weight factors respectively associated with the red, green and blue pixels; HE and VE represent numbers of pixel positions in horizontal and vertical directions, respectively; and g represents a gradation (gray) depth for the input frame.

Then, the method proceeds to operation S520 where the OLED device, for example, using the adjusted-APL generation unit 220, compares the first APL with a second APL, where the second APL is calculated for a previous input frame to the current input frame. A predetermined interval may exist in between the current and previous frames.

Next, the method proceeds to operation S530 where the OLED device, for example, using the adjusted-APL generation unit, determines whether the first APL is equal to the second APL or not.

Upon determination of whether or not the first APL is equal to the second APL, this method proceeds to operation S550 where the OLED device controls the luminance using the first APL or the second APL. In this case, the adjusted-APL generation unit 220 may not generate an adjusted-APL. Thus, the luminance may be kept unchanged.

Otherwise, upon determination of whether or not the first APL is equal to the second APL, this method proceeds to operation S540 where the generation unit 220 generates an adjusted-APL based on a difference therebetween. As disclosed above, the adjusted-APL may be any value between the first and second APLs to lower an APL change rate.

The adjusted-APL may be calculated based on a difference between the first and second APLs. One example of such an adjusted-APL generation may be as follows:

$$\text{Adjusted_APL} = \text{Second_APL} + (\text{First_APL} - \text{Second_APL})/\text{dimming slope}, \quad \text{(eq. 2)},$$

where the dimming slope may be employed to buffer an APL-change rate.

As seen from the above equation, with a lower dimming slope, the adjusted-APL may tend to be close to the first APL for the current input frame, resulting in a small contribution to the API change rate buffering. To the contrary, with a higher dimming slope, the adjusted-APL may tend to be close to the second APL for the previous input frame, resulting in a higher contribution to the API change rate buffering. In this way, the lower dimming slope may contribute to a higher APL change rate, namely a sharp APL change, while the higher dimming slope may contribute to a lower APL change rate, namely, a gentle APL change.

The second equation may result in two following conditions on the latter term "(First_APL−Second_APL)/dimming slope": positive and negative (in this case, "zero" case is excluded due to the first and second APLs being unequal. For these two conditions, an APL adjustment may be as follows:

(1) Current APL (first APL)>Previous APL (second APL): the APL for the current frame increases relative to the APL for the previous frame. In this case, additive APL adjustment may be applied. That is, the adjusted-APL may increase by the term "(First_APL−Second_APL)/dimming slope" value.

(2) Current APL (first APL)<Previous APL (second APL): the APL for the current frame decreases relative to the APL for the previous frame. In this case, subtractive APL adjustment may be applied. That is, the adjusted-APL may decrease by the term "(First_APL−Second_APL)/dimming slope" value.

The operation S540 may be triggered in a threshold-based. That is, the operation S540 may be performed only when the first APL is above a predetermined threshold.

Thereafter, the method proceeds to operation S560 where the OLED device, using the luminance adjustment unit 230, controls the luminance for the current frame based on the generated adjusted-APL. In other words, the luminance of the current frame may be adjusted in a corresponding manner to the adjusted-APL. The unit 230 may change the luminance by a predetermined value corresponding to the adjusted-APL.

Further, the OLED device, in particular, the image controller may store in a storage (not shown) the first, second and adjusted APLs, and control parameters (operation threshold, dimming slope, etc).

In one implementation, the storage may include a non-transitory computer-readable storage medium. The computer readable medium is a storage device for any data that can store data which can thereafter be read by a computer system. Examples of the computer readable medium include hard drives, network attached storage (NAS), logic circuits, read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

It should be understood that the instructions represented by the operations in the above figures are not required to be performed in the order illustrated, and that all the processing represented by the operations may not be necessary to practice the disclosure. Further, the processes described in any of the above figures can also be implemented in software stored in any one of or combinations of the RAM, the ROM, or the hard disk drive.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term controller may be replaced with the term semiconductor chip, circuit, etc. The term controller may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple controllers. The term group processor encompasses a processor that, in combination with additional processors, executes some or all code from one or more controllers. The term, shared memory, encompasses a single memory that stores some or all code from multiple controllers. The term group memory encompasses a memory that, in combination with additional memories, stores some or all code from one or more controllers. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored in at least one non-transitory tangible computer readable medium. The computer programs may also include and/or rely on stored data.

The present disclosure has been described in more detail with reference to the exemplary embodiments, but the present disclosure is not limited to the exemplary embodiments. It will be apparent to those skilled in the art that various modifications can be made without departing from the technical substance of the disclosure. Accordingly, the exemplary embodiments disclosed in the present disclosure are used not to limit but to describe the technical spirit of the present disclosure, and the technical substance of the present disclosure is not limited to the exemplary embodiments. Therefore, the exemplary embodiments described above are considered in all respects to be illustrative and not restrictive. The protection scope of the present disclosure must be interpreted by the appended claims and it should be interpreted that all technical substances within a scope equivalent thereto are included in the appended claims of the present disclosure.

It will be apparent to those skilled in the art that various modifications and variation can be made in the present invention without departing from the substance or scope of the invention. Thus, it is intended that the present invention cover the modifications and variations of this invention provided they come within the scope of the appended claims and their equivalents.

What is claimed is:

1. A display device comprising:

a display panel; and a plurality of drivers that control the display panel to display images and include an image control circuit, the image control circuit including:

an average picture level (APL) circuit that analyzes first and second input image data for first and second time intervals and calculates first and second APLs, respectively, wherein the second time interval precedes the first time interval, an adjusted-APL generator that generates an adjusted-APL for the first input image data based on a comparison between the first and second APLs, and a luminance adjustment controller that adjusts a luminance of the display panel for the first input image data based on the adjusted-APL, wherein the adjusted-APL generator generates the adjusted-APL based on the following equation:

$$\text{the adjusted-APL} = \text{the second APL} + (\text{the first APL} - \text{the second APL})/\text{a dimming slope},$$

where the dimming slope represents a buffering degree.

2. The display device of claim 1, wherein the first time interval has a same duration as the second time interval.

3. The display device of claim 2, wherein the first and second time intervals are one of a sub-frame, a single frame and multiple frames.

4. The display device of claim 1, wherein the first APL represents a ratio of an average brightness of the first input image data for the first time interval to a maximum brightness set for the first time interval.

5. The display device of claim 4, wherein the first APL is calculated by applying different weight factors to red, green and blue data of the first input image data.

6. The display device of claim 1, further comprising a memory that stores the second APL.

7. The display device of claim 1, wherein the adjusted-APL generator does not generate the adjusted-APL for the first input image data, when an absolute value of a difference between the first and second APLs or a value of the first APL is lower than a threshold value.

8. The display device of claim 1, wherein the luminance adjustment controller adjusts the luminance of the display panel for the first input image data based on the first APL, when an absolute value of a difference between the first and second APLs is lower than a threshold value.

9. The display device of claim 1, wherein the adjusted-APL generator includes a +/−calculator and a divider.

10. The display device of claim 1, further comprising a look-up table that stores a reference value corresponding to the adjusted-APL.

11. The display device of claim 10, wherein the luminance adjustment controller adjusts the luminance of the display panel for the first input image data in correspondence with the reference value in the look-up table.

12. The display device of claim 1, wherein the display panel is an organic light-emitting display device that includes an anode, a cathode and a light-emission layer between the anode and the cathode.

13. A method of driving a display device having a display panel, the method comprising:

analyzing first and second input image data for first and second time intervals and calculating first and second average picture levels (APLs), respectively, wherein the second time interval precedes the first time interval;

comparing the first APL with the second APL;

determining whether or not an absolute value of a difference between the first and second APLs is equal to or higher than a threshold value;

generating an adjusted-APL for the first input image data, when the absolute value of the difference between the first and second APLs or a value of the first APL is equal to or higher than the threshold value; and adjusting a luminance of the display panel for the first input image data based on the adjusted-APL, wherein the generating the adjusted-APL is based on the following equation:

the adjusted-APL=the second APL+(the first APL−the second APL)/a dimming slope, where the dimming slope represents a buffering degree.

14. The method of claim 13, wherein the adjusting the luminance of the display panel for the first input image data is based on the first APL, when the absolute value of the difference between the first and second APLs is lower than the threshold value.

15. The method of claim 13, wherein the first time interval has a same duration as the second time interval, and wherein the first and second time intervals are one of a sub-frame, a single frame and multiple frames.

16. The method of claim 13, further comprising storing the second APL in a memory.

17. The method of claim 13, wherein the adjusting the luminance of the display panel for the first input image data is in correspondence with a reference value stored in a look-up table.

18. The method of claim 13, wherein the display panel is an organic light-emitting display device that includes an anode, a cathode and a light-emission layer between the anode and the cathode.

* * * * *